US005538561A

United States Patent [19]

Brown et al.

[11] Patent Number: 5,538,561

[45] Date of Patent: Jul. 23, 1996

[54] METHOD FOR CLEANING ALUMINUM AT LOW TEMPERATURES

[75] Inventors: Malcolm D. Brown, Glen Waverley; Shane P. Lambden, Kalorama, both of Australia

[73] Assignee: Henkel Corporation, Plymouth Meeting, Pa.

[21] Appl. No.: 335,799

[22] PCT Filed: May 12, 1993

[86] PCT No.: PCT/US93/04316

§ 371 Date: Nov. 14, 1994

§ 102(e) Date: Nov. 14, 1994

[87] PCT Pub. No.: WO93/23590

PCT Pub. Date: Nov. 25, 1993

[30] Foreign Application Priority Data

May 14, 1992 [AU] Australia ..... PL2410/92

[51] Int. Cl.[6] ..... C23G 1/02; C23G 1/12

[52] U.S. Cl. ..... 134/3; 134/41

[58] Field of Search ..... 134/3, 41

[56] References Cited

U.S. PATENT DOCUMENTS

| | | | |
|---|---|---|---|
| Re. 32,661 | 5/1988 | Binns | 134/3 |
| 3,969,135 | 7/1976 | King et al. | 134/40 |
| 4,124,407 | 11/1978 | Binns | 134/3 |
| 4,348,294 | 9/1982 | King | 252/142 |
| 4,370,173 | 1/1983 | Dollman | 134/3 |
| 4,668,421 | 5/1987 | Dollman | 134/3 |

FOREIGN PATENT DOCUMENTS

| | | |
|---|---|---|
| 0043164 | 1/1982 | European Pat. Off. . |
| 2340380 | 9/1977 | France . |
| 2098630 | 11/1982 | United Kingdom . |
| 2100757 | 1/1983 | United Kingdom . |
| 2121073 | 12/1983 | United Kingdom . |

*Primary Examiner*—Jill Warden
*Assistant Examiner*—Zeinab El-Arini
*Attorney, Agent, or Firm*—Ernest G. Szoke; Wayne C. Jaeschke; Norvell E. Wisdom, Jr.

[57] ABSTRACT

An acidic cleaning process for aluminum, especially aluminum cans, that includes a pre-cleaning washing stage followed by an acid cleaning stage is improved by including in the pre-cleaning washing solution both of (i) a component of polyalkoxylated straight or branched chain alcohol surfactant and (ii) a component of polyalkylene glycol-abietic acid surfactant, which are maintained during the process in a ratio of component (i) to component (ii) within the range from 0.4:1 to 3.0:1. The method is particularly useful when the acid cleaning stage also contains both these types of surfactants, but at a lower ratio. A pre-cleaner replenisher composition including water, sulfuric acid, and polyalkoxylated straight or branched chain alcohol surfactant is advantageously used in the process.

20 Claims, No Drawings

METHOD FOR CLEANING ALUMINUM AT LOW TEMPERATURES

TECHNICAL FIELD

This invention relates to the cleaning of aluminum surfaces. In particular, it is directed to the cleaning of the surfaces of aluminum cans formed by a cold forming operation.

BACKGROUND ART

After can formation by cold forming, aluminum fines, lubricating oils and other contaminants remain on the surface. It is necessary to clean the surface thoroughly prior to the further treatment which often includes the application of one or more surface coatings.

Early cleaning compositions for aluminum surfaces proposed the use of aqueous acidic compositions either alone or with added fluoride at temperatures in the range of 185° to 200° F. (85° to 93° C.). In U.S. Pat. No. 4,009,115 and its Re-Issue No. 32,661, Binns proposed the addition of 0.05 to 0.1 grams per liter of hydrofluoric acid as a means of reducing the processing temperature to within the range of 90° to 135° F. (32° to 57° C.). The compositions proposed by Binns preferably contain 0.1 to 10 grams per liter of a surfactant which could be anionic, cationic or nonionic.

King et al. in U.S. Pat. No. 3,969,135 proposed the use of an aqueous acidic cleaning composition containing a blend of two surfactants. This composition was also suitable for relatively low temperature use and preferably contained 0.01 to 0.4 weight percent of a fluoride accelerator. The surfactants proposed by King et al. (hereinafter abbreviated as simply "King") were a polyalkoxylated straight chain alcohol and a polyalkylene glycol-abietic acid surfactant. The King compositions are currently used in one or more, preferably at least two, cleaning stages in the commercial production of aluminum cans, but not usually in the first stage. Normal current practice is to provide most of the acidity in the precleaning stage, immediately before washing the cans with a cleaner composition as taught by King, by directing part of the acid cleaner washing solution into the pre-cleaner washing solution, which otherwise consists largely of tap water, with optional additions of acid. When a second stage acid washing solution as taught by King is used in this manner, the ratio between the two kinds of surfactants normally will be the same in the fast stage as in the second, if nothing else is added to the fast stage solution, inasmuch as no preferential dragout of one type of surfactant has been observed.

Washing operations with solutions that include nonionic surfactants are normally conducted at or slightly below the cloud point of the washing solution, which is the temperature at which the surfactant comes out of or goes into aqueous solution with changing temperature. It is a characteristic of most nonionic surfactants, including those taught by King as noted above, that they become less soluble in water as the temperature of an aqueous surfactant composition is raised. At temperatures significantly below the cloud point of a particular composition, foaming of the aqueous solution generally occurs quite easily, and it is desirable to avoid foaming in the present washing operations. If the temperature of the composition is too far above the cloud point, separation of the surfactant from the aqueous medium occurs and leads to a loss of detergent ability and a loss of the actual surfactant material. Accordingly, the present washing operations are normally conducted at or below the cloud point where the detergent ability of the composition is still effective and foaming can be minimized.

DISCLOSURE OF THE INVENTION

Problems to Be Solved by the Invention

While the methods described above are effective in cleaning the aluminum surfaces, removal of oil from the used washing solutions is necessary to prevent environmental pollution upon discharge of the used solutions. It is therefore an object of the present invention to provide a method which will not only be cost effective but will also allow an easier separation from the used washing solution of the oil which that solution has removed from the washed surface. Another object of the present invention is to provide a method of cleaning surfaces which will use the improved cleaning method in conjunction with the composition and equipment of the kind currently used in the production of aluminum cans. Still another object of the invention is to provide a process for satisfactory cleaning at a lower temperature than prior art processes, thereby making more economical operation possible. Other objects will be apparent from the description below.

SUMMARY OF THE INVENTION

In one of its major embodiments, the present invention is based on the discovery that the ratio of the concentration of polyalkoxylated alcohol surfactant to the concentration of polyalkylene glycol-abietic acid surfactant (this ratio being hereinafter briefly denoted "the surfactant ratio") that is optimum for the acid cleaner stage as taught in the King patent already noted above is not usually optimum for the pre-cleaning stage used immediately before the acid cleaner. In addition, independently, it has been discovered that the acid composition normally used in an acid cleaning solution as taught by King can usefully be supplemented with additional sulfuric acid for the pre-cleaner stage. Accordingly, one embodiment of the invention is the provision of a prewashing solution composition with these improved characteristics before, preferably immediately before, a conventional acid cleaning solution in a cleaning operation with at least two stages.

Both these improvements in the pre-cleaner solution can conveniently be achieved by adding to it during the course of the washing process a replenisher composition that comprises, more preferably consists essentially of, or still more preferably consists of water, sulfuric acid, and a polyalkoxylated straight or branched, but preferably straight, chain alcohol surfactant. The content of sulfuric acid in the replenisher composition is preferably determined by the pH required in use of the composition, and the content of surfactant is adjusted to maintain the stability of the composition. In particular, the composition may contain 5 to 50 per cent by weight of sulfuric acid and 0.5 to 40 per cent by weight of said surfactant.

In the method of one embodiment of the invention, such a composition is added to a washing solution as a replenisher composition in a stage preceding, preferably immediately preceding, a conventional acid cleaner stage, such as is taught by Binns or King. The use of such a composition as a replenisher is another aspect of the present invention.

DETAILED DESCRIPTION OF THE INVENTION

The pre-cleaner stage of a process according to one embodiment of this invention preferably contains both of (i) a component of polyalkoxylated straight or branched chain, preferably straight chain, alcohol surfactant and (ii) a component of polyalkylene glycol-abietic acid surfactant as taught by King. However, the ratio between these two types in the pre-cleaner stage of a process according to this invention preferably is within the range from 0.4:1 to 3.0:1, more preferably within the range from 0.7:1 to 2.0:1, still more preferably within the range from 0.9:1.0 to 1.3:1.0, and most preferably within the range from 1.0:1.0 to 1.2:1.0. (In contrast, the most preferred range for the second acid cleaner stage as taught by King, and as preferably used as the next subsequent process in this invention, after the pre-cleaner stage as described above, is about 0.3) Independently, the pH of the pre-cleaning solution in a process according to this invention is preferably within the range from 1.4 to 2.0, more preferably within the range from 1.6 to 2.0, or still more preferably within the range from 1.75 to 1.85, and this pH is preferably achieved by adding to the water used for the pre-cleaning solution only sulfuric acid, in addition to whatever acid is added by countercurrent flow from the subsequent cleaner stage solution.

In a preferred embodiment, the values as described above for the pre-cleaner stage solution are achieved by adding to the original solution during the continued operation of the process a pre-cleaner replenisher composition, in addition to a counterflow from the subsequent acid cleaner solution stage. A pre-cleaner replenisher composition for the present invention comprises, more preferably consists essentially of, or still more preferably consists of, a stable aqueous solution of sulfuric acid with a polyalkoxylated straight or branched chain alcohol surfactant. This improved composition is formulated to be used as a replenisher for the pre-cleaner washing solution which is actually applied to the aluminum surfaces. It may be used alone but is preferably formulated for use in co-operation with the type of composition proposed by King et al., using successive cleaning stages in the can washing equipment. The relative concentration of the components in the composition of the present invention will preferably depend upon the type of system in which the composition is to be used, that is whether the composition is to be used alone or in conjunction with one of the known cleaning compositions.

It has been found that a stable and satisfactory pre-cleaner replenisher composition in accordance with the present invention can be prepared containing 5 to 50 per cent by weight of sulfuric acid and 0.5 to 40 per cent by weight of surfactant. Preferably, the composition contains 30 to 41 per cent by weight of sulfuric acid and 4 to 10 per cent by weight of surfactant; most preferably 41 per cent by weight of sulfuric acid is used. The sulfuric acid content can be varied depending on the way in which the composition is to be used and any such variation will preferably be accompanied by a corresponding variation in the range of surfactant material present. However, once the acid content has been determined, the surfactant content to provide an optimally stable and useful composition can also readily be determined.

The acid content may require variation depending upon the amount and type of material to be cleaned from the surfaces being treated. This will vary with the type of lubricant used in the can formation and with other factors such as the condition of the forming equipment.

Suitable polyalkoxylated straight or branched chain alcohol surfactants are known in the art as nonionic surfactants. They include those sold under the trade names Antarox LF 330, Teric 165 and Trycol LF 1. These surfactants are known to have a low cloud point and their use in the present compositions assists in further lowering the temperature at which the washing operation is conducted.

It has been found that the compositions of the present invention can be used to significantly lower the pH of the pre-cleaner washing solution in use from the value that it would have if acidified by counterflow from a subsequent acid cleaner stage alone. The reduction in pH which can be thus achieved has been found to improve the cleaning efficiency of the washing solution and the efficiency with which oil can removed.

In a preferred application of the present invention, the improved composition is used in the first of two stages of a washing operation, the second stage using either a known composition of the type proposed by King et al or a composition of this known type modified to co-operate with the composition of the present invention. The following comparison example and example of this preferred use of the invention will further assist an understanding of the benefits which the invention provides.

COMPARISON EXAMPLE

In a can processing plant including a multi-stage washing section, cans leaving the body maker-trimmer operation section travel on a perforated mat through a precleaner washing stage (stage 1) and then through a cleaner stage (stage 2). In accordance with the known washing procedure, washing solution is initially made up with the desired proportion of active ingredients. The composition of the washing solution is maintained by the addition of appropriate replenisher compositions to compensate for the depletion of active materials as the washing procedure continues. The washing solution is sprayed over the can surfaces in the second section and a portion of the washing composition, carrying aluminum, oils, and other materials removed from the can in stage 2, travels in countercurrent to the movement of the cans to stage 1.

In a typical operation using a composition of the type suggested by King et al, the washing solution used in the stage 2 process contains a polyalkylene glycol-abietic acid surfactant blended with a polyalkoxylated straight or branched chain alcohol. A typical washing solution containing approximately 0.065 per cent of the abietic acid derivative sold under the trade designation Teric RA 1315 and approximately 0.023 per cent of the polyalkoxylated straight chain alcohol sold under the trade name Antarox LF 330, as well as sulfuric acid and hydrofluoric acid, provides eight points of free acid in stage 2 at a pH of approximately 1.2. The amount of surfactant blend and acids used in accordance with this process may be varied to provide between 3 to 20 points of free acid.

The washing solution from stage 2 is counterflowed to stage 1 at a rate determined by measuring the amount of dissolved aluminum in the solution. The amount of sulfuric acid in the washing solution is depleted because the acid dissolves aluminum in the course of its cleaning action. The balance of active components in the acid cleaner washing solution is maintained, most preferably by the addition of appropriate amounts of a replenisher composition. (This replenisher composition for the acid cleaner will normally have different composition from the pre-cleaner replenisher that is part of this invention.)

In a typical can washer, for a flow rate of washing solution from stage 2 to stage 1 of five liters per minute, the amount of active acid cleaner replenisher composition is approximately 65 milliliters per minute. The rate at which the washing solution from stage 2 is added to the stage 1 washing process is also controlled to determine the amount of free acid remaining in the washing solution used in pre-cleaner stage 1. If the acid washing solution is added to stage 1 to provide one point of free acid, the pH is approximately 2.1. If two points of free acid are added by the stage 2 washing solution to stage 1, the pH is approximately 1.8.

EXAMPLE ACCORDING TO THE PRESENT INVENTION

The known process described above can be improved by using a pre-cleaner replenisher composition according to the present invention. Thus a pre-cleaner replenisher composition as described above can be added to stage 1 to supplement the free acid content of the total washing solution in this stage. For example, if approximately one point of free acid in stage 1 is contributed by the counterflow of the washing solution from stage 2, and approximately one point of free acid is contributed by a preferred pre-cleaner replenisher composition for the present invention, the additional polyalkoxylated straight or branched chain alcohol added by the composition of the present invention changes the ratio of the concentration of polyalkoxylated alcohol surfactant to the concentration of polyalkylene glycol-abietic acid surfactant ("the surfactant ratio") from approximately 0.3 to approximately 1.1, thus significantly lowering the cloud point of the stage 1 washing solution. This addition also alters the pH from approximately 2.1 to approximately 1.8.

It has been found that changing the surfactant ratio, by the addition of polyalkoxylated straight or branched chain alcohol surfactant, to the stage 1 washing solution can lead to a reduction of approximately 10° C. in the cloud point. The extent to which the cloud point is lowered will directly influence the extent to which oil is separated from the washing solution.

Based on the use of approximately 65 milliliters of active replenisher composition per minute in the counterflowed stage 2 washing solution being required to maintain one point free acid in the stage one process, the mount of pre-cleaner replenisher composition according to the present invention required would be approximately 32 milliliters per minute or 50 liters per day.

Use of an improved pre-cleaner replenishing composition of the invention as described in the preceding example can be modified in accordance with the required flow rates necessary to achieve efficient cleaning of the particular cans being processed and more efficient oil removal from the washing solution. In addition, the composition of the (generally different) replenisher solution added to the stage 2 cleaning process can be varied to take into account the effect of the improved cleaning achieved in the stage 1 process by use of the cleaning composition of the present invention. The composition of the replenisher added to the stage 2 processing may also be varied to allow for the effect, on the concentrations and ratios of its active materials, of the materials which may be carried over into the stage 2 process, by the cans moving from stage 1, when an improved composition according to this invention is used for the washing solution in pre-cleaner stage 1.

The invention claimed is:

1. A can washing process comprising passing initially soiled aluminum cans through a pre-cleaner washing stage in which the initially soiled aluminum cans are washed with a pre-cleaner washing solution and a subsequent acid cleaner stage in which the aluminum cans are washed with an acid cleaner washing solution, wherein the pre-cleaner washing solution consisting essentially of water, sulfuric acid, and both of (i) a component of polyalkoxylated straight or branched chain alcohol surfactant and (ii) a component of polyalkylene glycol-abietic acid surfactant, which are maintained during the process in a ratio of component (i) to component (ii) within a range from 0.4:1 to 3.0:1, said ratio of component (i) to component (ii) in the pre-cleaner washing solution being different from the ratio between component (i) and component (ii) in the acid cleaner washing solution and wherein, during the process, a replenisher solution different in composition from whatever addition to the pre-cleaner washing solution by overflow from the washing solution for the subsequent acid cleaning stage is added to the washing solution used in the pre-cleaner stage.

2. A process according to claim 1, wherein the ratio of component (i) to component (ii) is within the range from 0.7:1 to 2.0:1.

3. A process according to claim 2, wherein the ratio of component (i) to component (ii) is within the range from 0.9:1.0 to 1.3:1.0, and component (i) is selected from polyalkoxylated straight chain alcohols.

4. A process according to claim 3, wherein the pre-cleaner washing solution has a pH that is maintained during the process within a range from 1.75 to 1.85.

5. A process according to claim 4, wherein the acid cleaner washing solution comprises both of (i) a component of polyalkoxylated straight or branched chain alcohol surfactant and (ii) a component of polyalkylene glycol-abietic acid surfactant, which are maintained during the process in a ratio of component (i) to component (ii) less than 0.4:1; during the process, a portion of the acid cleaner washing solution is countercurrently introduced into the pre-cleaner washing solution; and during the process, a pre-cleaner replenisher composition consisting essentially of water, sulfuric acid, and a component of polyalkoxylated straight or branched chain alcohol surfactant is also introduced into the pre-cleaner washing solution.

6. A process according to claim 5, wherein the pre-cleaner replenisher composition contains 30 to 41 per cent by weight of sulfuric acid and 4 to 10 per cent by weight of surfactant.

7. A process according to claim 3, wherein the acid cleaner washing solution comprises both of (i) a component of polyalkoxylated straight or branched chain alcohol surfactant and (ii) a component of polyalkylene glycol-abietic acid surfactant, which are maintained during the process in a ratio of component (i) to component (ii) less than 0.4:1; during the process, a portion of the acid cleaner washing solution is countercurrently introduced into the pre-cleaner washing solution; and during the process, a pre-cleaner replenisher composition consisting essentially of water, sulfuric acid, and a component of polyalkoxylated straight or branched chain alcohol surfactant is also introduced into the pre-cleaner washing solution.

8. A process according to claim 7, wherein the pre-cleaner replenisher composition contains 30 to 41 per cent by weight of sulfuric acid and 4 to 10 per cent by weight of surfactant.

9. A process according to claim 2, wherein the pre-cleaner washing solution has a pH that is maintained during the process within a range from 1.6 to 2.0.

10. A process according to claim 9, wherein the acid cleaner washing solution comprises both of (i) a component of polyalkoxylated straight or branched chain alcohol surfactant and (ii) a component of polyalkylene glycol-abietic acid surfactant, which are maintained during the process in a ratio of component (i) to component (ii) less than 0.4:1; during the process, a portion of the washing solution from the acid cleaner stage is countercurrently introduced into the pre-cleaner washing solution; and during the process, a pre-cleaner replenisher composition consisting essentially of water, sulfuric acid, and a component of polyalkoxylated straight or branched chain alcohol surfactant is also introduced into the pre-cleaner washing solution.

11. A process according to claim 10, wherein the pre-cleaner replenisher composition contains 5 to 50 per cent by weight of sulfuric acid and 0.5 to 40 per cent by weight of surfactant.

12. A process according to claim 11, wherein the pre-cleaner replenisher composition contains 30 to 41 per cent by weight of sulfuric acid and 4 to 10 per cent by weight of surfactant.

13. A process according to claim 2, wherein the acid cleaner washing solution comprises both of (i) a component of polyalkoxylated straight or branched chain alcohol surfactant and (ii) a component of polyalkylene glycol-abietic acid surfactant, which are maintained during the process in a ratio of component (i) to component (ii) less than 0.4:1; during the process, a portion of the washing solution from the acid cleaner stage is countercurrently introduced into the pre-cleaner washing solution; and during the process, a pre-cleaner replenisher composition consisting essentially of water, sulfuric acid, and a component of polyalkoxylated straight or branched chain alcohol surfactant is also introduced into the pre-cleaner washing solution.

14. A process according to claim 13, wherein the pre-cleaner replenisher composition contains 30 to 41 per cent by weight of sulfuric acid and 4 to 10 per cent by weight of surfactant.

15. A process according to claim 1, wherein the pre-cleaner washing solution has a pH that is maintained during the process within a range from 1.4 to 2.0.

16. A process according to claim 15, wherein the acid cleaner washing solution comprises both of (i) a component of polyalkoxylated straight or branched chain alcohol surfactant and (ii) a component of polyalkylene glycol-abietic acid surfactant, which are maintained during the process in a ratio of component (i) to component (ii) less than 0.4:1; during the process, a portion of the washing solution from the acid cleaner stage is countercurrently introduced into the pre-cleaner washing solution; and during the process, a pre-cleaner replenisher composition consisting essentially of water, sulfuric acid, and a component of polyalkoxylated straight or branched chain alcohol surfactant is also introduced into the pre-cleaner washing solution.

17. A process according to claim 16, wherein the pre-cleaner replenisher composition contains 5 to 50 per cent by weight of sulfuric acid and 0.5 to 40 per cent by weight of surfactant.

18. A process according to claim 17, wherein the pre-cleaner replenisher composition contains 30 to 41 per cent by weight of sulfuric acid and 4 to 10 per cent by weight of surfactant.

19. A process according to claim 1, wherein the acid cleaner washing solution comprises both of (i) a component of polyalkoxylated straight or branched chain alcohol surfactant and (ii) a component of polyalkylene glycol-abietic acid surfactant, which are maintained during the process in a ratio of component (i) to component (ii) less than 0.4:1; during the process, a portion of the acid cleaner washing solution is countercurrently introduced into the pre-cleaner washing solution; and during the process, a pre-cleaner replenisher composition consisting essentially of water, sulfuric acid, and a component of polyalkoxylated straight or branched chain alcohol surfactant is also introduced into the pre-cleaner washing solution.

20. A process according to claim 19, wherein the pre-cleaner replenisher composition contains 5 to 50 per cent by weight of sulfuric acid and 0.5 to 40 per cent by weight of surfactant.

* * * * *